United States Patent [19]

Reynolds et al.

[11] 4,175,670

[45] Nov. 27, 1979

[54] CONTAINER CONSTRUCTION

[75] Inventors: William G. Reynolds, Richmond; Horst F. W. Arfert, Midlothian, both of Va.

[73] Assignee: Reynolds Metals Company, Richmond, Va.

[21] Appl. No.: 889,037

[22] Filed: Mar. 22, 1978

[51] Int. Cl.[2] ..... B65D 7/44

[52] U.S. Cl. ..... 220/70; 220/66; 220/72

[58] Field of Search ..... 220/66, 70, 72; 215/1 C; 206/520

[56] References Cited

U.S. PATENT DOCUMENTS

| | | | |
|---|---|---|---|
| 651,884 | 6/1900 | Platz | 220/70 |
| 1,461,729 | 7/1923 | Foster et al. | 220/70 X |
| 1,762,903 | 6/1930 | Werder | 220/66 X |
| 1,788,261 | 1/1931 | Werder | 220/70 X |
| 2,541,065 | 2/1951 | Jabour | 220/70 X |
| 2,755,644 | 7/1956 | Watson | D7/3 X |
| 2,894,844 | 7/1959 | Shakman | 220/66 X |
| 2,932,437 | 4/1960 | Wilcox | D7/9 X |
| 2,936,920 | 5/1960 | Wallace | 220/70 X |
| 2,988,258 | 6/1961 | Witzke | 206/520 X |
| 3,038,627 | 6/1962 | Daley | 220/70 X |
| 3,043,461 | 7/1962 | Glassco | 220/70 X |
| 3,501,043 | 3/1970 | Jernberg | 220/66 |
| 3,514,812 | 6/1970 | Evers | 215/1 C X |
| 3,927,790 | 12/1975 | Chase et al. | 220/72 |
| 3,973,693 | 8/1976 | Brocklehurst | 220/70 X |
| 3,979,009 | 9/1976 | Walker | 220/70 X |
| 4,037,752 | 7/1977 | Dulmaine et al. | 220/70 |

FOREIGN PATENT DOCUMENTS

| | | | |
|---|---|---|---|
| 1571499 | 6/1969 | France | 215/1 C |
| 20424 | of 1904 | United Kingdom | 220/70 |
| 840634 | 7/1960 | United Kingdom | 220/70 |
| 874211 | 8/1961 | United Kingdom | 220/70 |

*Primary Examiner*—Allan N. Shoap

*Attorney, Agent, or Firm*—Glenn, Lyne, Girard, Clark & McDonald

[57] ABSTRACT

In an easily hand-held metal container construction for containing a product under pressure wherein the container construction has an outwardly convex bottom wall and an adjoining side wall defined as a single-piece structure with the side wall terminating at a top portion adapted to have a top closure fixed thereon, the improvement wherein the downwardly convex bottom wall has a plurality of integral feet supporting the container construction thereon, each of the feet being defined by a downwardly convex dimple having a base portion provided with an outer periphery, a rounded outer portion, and a wall thickness which is substantially the same thickness as the remainder of the bottom wall, and each of the dimples having a central axis and the outer periphery of its base portion disposed radially inwardly from the side wall by a distance at least equal to one half the minimum dimension across the outer periphery measured through the central axis.

12 Claims, 12 Drawing Figures

CONTAINER CONSTRUCTION

CROSS REFERENCE TO RELATED APPLICATION

This application is related to applicants' copending design application, Ser. No. 957,794 filed Nov. 3, 1978, which is a continuation, and design application Ser. No. 957,796, filed Nov. 3, 1978, which is a division of design application Ser. No. 720,494, filed Sept. 3, 1976, now abandoned.

BACKGROUND OF THE INVENTION

Metal containers, whether made of ferrous metals or non-ferrous metals such as aluminous metals, of the type which are easily held in one hand and used to contain products under gaseous pressure, such as carbonated beverages, deodorants, household sprays for various purposes, paint, and the like are widely used.

Accordingly, there is great competition in the manufacture and sale of such metal containers. It is well known in the art to provide such metal containers wherein each has a bottom wall and an adjoining side wall made as a single-piece structure and with the bottom wall being outwardly convex and having a thickness which is less than the thickness of a more conventional outwardly concave bottom wall whereby the amount of metal and cost of the resulting container is reduced. In providing a container having an outwardly convex bottom wall, it is necessary to provide means for supporting the container in an upright manner and in U.S. Pat. No. 3,838,789, for example, such a container employs a supporting base which is fixed around the lower portion of the side wall for the purpose of supporting the container in an upright manner.

However, any container which requires an additional component part, such as a supporting base, invariably adds to the manufacturing cost and the cost of the material required to manufacture and assemble each additional component part whereby such container is less cost competitive.

SUMMARY

It is a feature of this invention to provide an improved container construction of the character mentioned which is comprised basically of two main component parts defined by one part having a downwardly convex bottom wall and an adjoining side wall defined as a single-piece structure with the side wall having an open top and a second part in the form of a top closure which is fixed to the top portion of the open top of the side wall closing same and wherein the downwardly convex bottom wall has integral feet of optimum simplicity which support the container construction in an upright manner.

In particular, the bottom wall of the container construction of this invention when viewed on any cross-sectional plane coinciding with the longitudinal axis of such container construction has a central part which extends in a substantially circular first radius and a peripheral part defined by a side portion which blends smoothly with the central part and the side wall with the said side portion extending in a particular second radius. The integral feet in the downwardly convex bottom wall are each defined by a downwardly convex dimple having a base portion provided with an outer periphery, a rounded outer portion, and a wall thickness which is substantially the same thickness as the remainder of the bottom wall and each of the dimples has a central axis and has the outer periphery of its base portion disposed radially inwardly from the side wall by a distance at least equal to one half of the minimum dimension across the outer periphery measured through the central axis.

Further details and advantages of this invention will become apparent as the following description of the embodiments thereof in the accompanying drawings proceeds.

BRIEF DESCRIPTION OF THE DRAWINGS

The accompanying drawings show present preferred embodiments of this invention, in which.

DESCRIPTION OF ILLUSTRATED EMBODIMENTS

Figure 1:
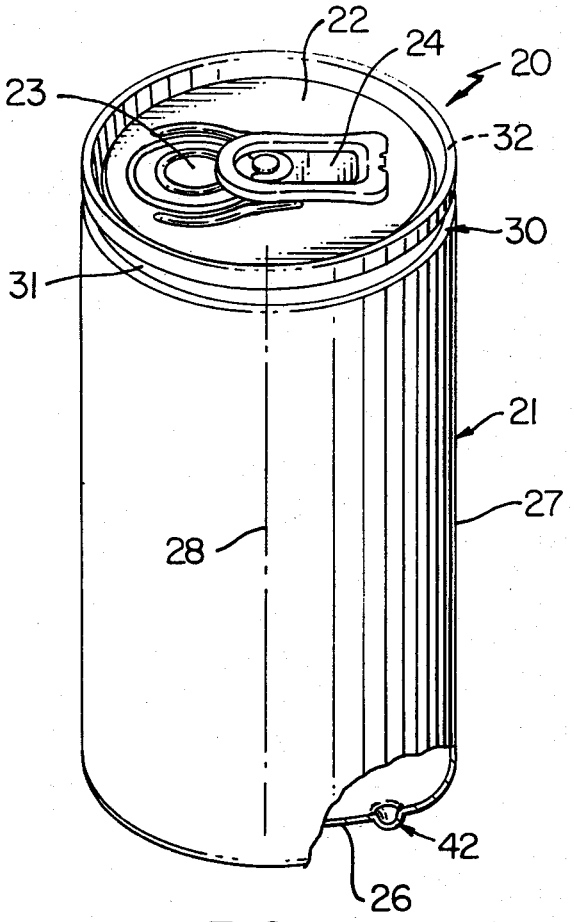
FIG. 1 is a perspective view with a fragmentary portion thereof broken away illustrating one exemplary embodiment of a container construction of this invention which has a right circular cylindrical side wall with a top closure fixed thereon to define an exemplary beverage container.
Figure 2:
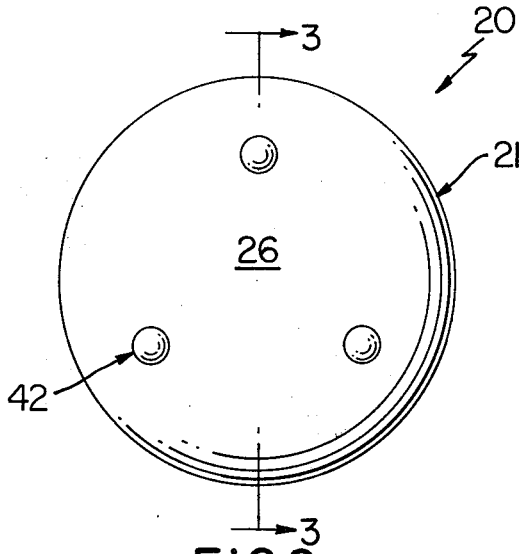
FIG. 2 is a view looking perpendicularly toward the bottom wall of the container construction of FIG. 1 with the bottom wall intact.
Figure 3:
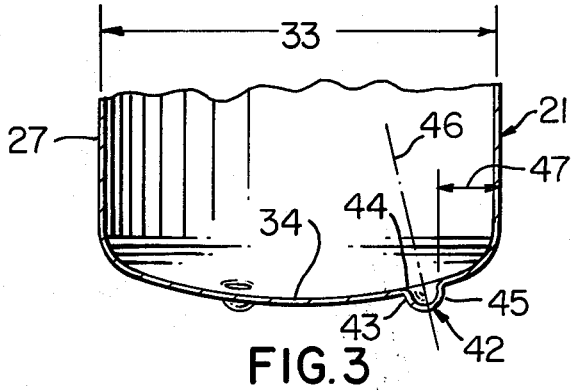
FIG. 3 is a fragmentary cross-sectional view taken essentially on the line 3—3 of FIG. 2.

Reference is now made to FIGS. 1–3 of the drawings which illustrate one exemplary embodiment of an easily hand-held metal container construction or container popularly referred to as a can which is designated generally by the reference numeral 20; and, although such container 20 may contain any suitable product, including products mentioned in the background of the invention, in this example the container 20 is shown as a container particularly adapted to contain a carbonated beverage which may be in the form of a carbonated soft drink or an alcoholic beverage, such as beer, or the like.

The container or can 20 is basically comprised of two major parts in the form of an open top container construction 21 of this invention and a top closure 22 of known construction. The closure 22 preferably employs a non-detachable yet severable panel 23 of a type which is known in the art and a non-detachable push tab 24 for severing the panel 23 and defining a dispensing opening therein and as disclosed in U.S. Pat. No. 3,967,752, for example, the disclosure of which is incorporated herein by reference thereto.

The container construction 21 has a downwardly convex bottom wall 26 and an adjoining right circular cylindrical side wall 27 which are defined as a single-piece structure and construction 21 has a central longitudinal axis 28. The side wall 27 terminates in a top portion 30 which has a reduced diameter portion 31 provided with a peripheral flange 32 which has top closure 22 fixed thereon in accordance with any suitable technique known in the art, such as a mechanical seaming process, for example. The top portion 30 when viewed on a plane perpendicular to the central longitudinal axis 28 of the container construction 21 has a circular cross-sectional configuration and a particular diameter which is basically the diameter 33 shown in FIG. 3 as the nominal diameter of the right circular cylindrical side wall 27.

Figure 11:
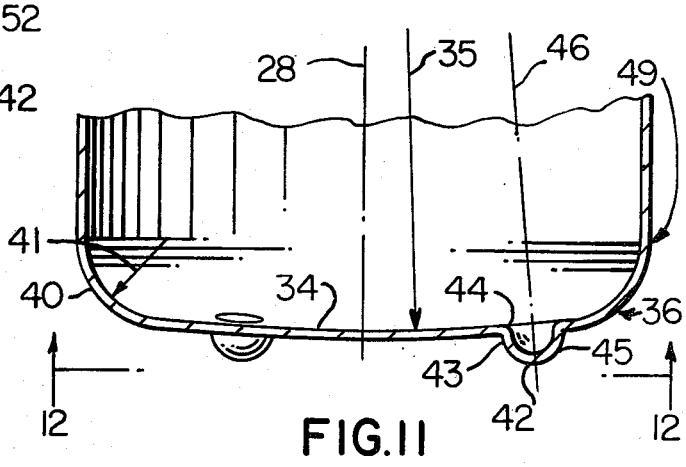
FIG. 11 is a fragmentary view particularly highlighting the manner in which the central part of the bottom wall of the container construction of this invention blends smoothly with the peripheral part at each side of the bottom wall of the container construction and also highlighting the location of a typical dimple relative to the side wall of the container construction.
Figure 10:
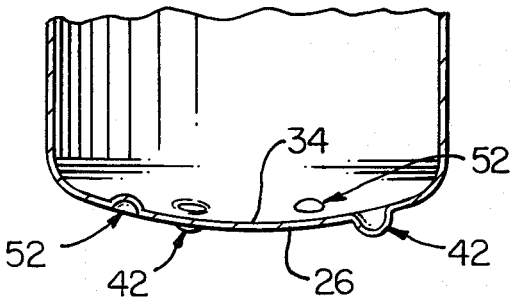
FIG. 10 is a fragmentary cross-sectional view taken essentially on the line 10—10 of FIG. 9.

The bottom wall 26 of the container construction 21 and hence container 20, when viewed on any cross-sectional plane coinciding with the longitudinal axis 28 of the container construction 21 has a central part 34 which as best seen in FIG. 11 extends in a substantially first radius 35 and a peripheral part 36 defined by a side portion when viewed on a cross-sectional plane coinciding with the longitudinal axis 28 which blends smoothly with the central part 34 and side wall 27. The side portion of the peripheral part 36 as viewed in FIG. 11 is designated by the reference numeral 40 and extends in a second radius 41.

The downwardly convex bottom wall 26 has a plurality of three integral feet 42 for supporting the container construction 21 and overall container 20 thereon and each of such feet is defined by a downwardly convex dimple 42. As seen in FIG. 3 each dimple 42 has a base portion 43 provided with an outer periphery 44 and a rounded outer portion 45. In addition, each dimple 42 has a wall thickness which for all practical purposes is substantially the same or identical to the thickness of the remainder of the bottom wall 26.

Each dimple 42 has a central axis 46 therethrough, with a typical axis 46 being designated by dot-dash lines in FIG. 3; and, the outer periphery 44 of each base portion 43 of each dimple 42 is disposed radially inwardly from the side wall 27 by a distance 47 at least equal to one-half the minimum dimension across the outer periphery 44 measured through the central axis 46 of a particular dimple 42. The outer periphery 44 of each dimple 42 of FIGS. 1–3 and 11 is circular whereby such outer periphery 44 is disposed radially inwardly from the side wall 27 by distance 47 which is at least equal to one-half the diameter of the circular outer periphery 44.

The container construction 21 is comprised of component portions which are easily formed. For example, the central part 34 of the bottom wall 26 is defined by a portion of a hollow sphere having radius 35; and, the peripheral part 36 is defined by a portion of a hollow toroid wherein the plane closed curve which is rotated about the usual axis to define a toroid is a circle having the radius 41.

The feet 42 of the container construction 21 should be provided sufficiently close to the side wall 27 and spaced sufficiently from the longitudinal axis 28 to provide stability for the container construction 21 and overall container 20. Further, it is very important that the radius 35 of the central part 34 of the bottom wall 26 be sufficiently large to prevent wrinkling of the bottom wall 26 during forming; and, the ratio between the radius 35 of the central part and the radius 41 of the peripheral part 36 should be such that it provides a smooth transition therebetween free of sharp corners and with minimum wrinkling.

In particular, it has been found that best results are obtained when the radius 35 of the central part 34 is within the range of 2 to 7 tmes greater than the dimension of the particular diameter 33. This radius 35 is measured from a point on the central longitudinal axis 28, and this point may extend above the height of the container 21. Similarly, best results have been obtained when the radius 41 of the peripheral part 36 is within the range of 1/10 to 1/5 the dimension of the diameter 33.

Figure 12:
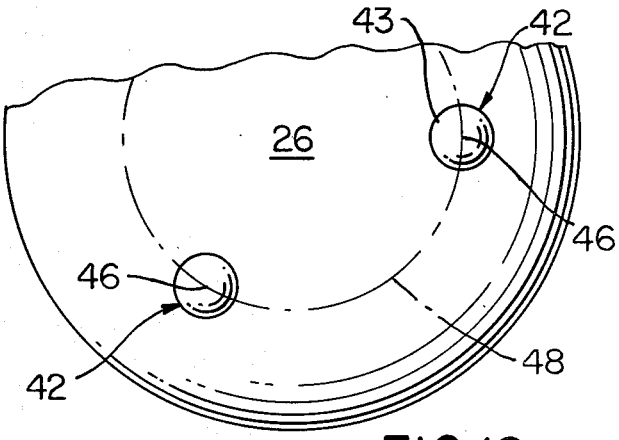
FIG. 12 is a fragmentary view taken essentially on the line 12—12 of FIG. 11.

Referring to FIGS. 11 and 12 of the drawings, it is seen that the central part 34 and the peripheral part 36 blend smoothly together substantially on an imaginary circular line shown as a circular dot-dash line 48 in FIG. 12 and each foot or dimple 42 is disposed with its central axis 46 adjacent and preferably within such imaginary circular line 48. In this example each axis 46 is shown through circular line 48. The peripheral part 36 also blends smoothly with the side wall 27 as shown at 49.

Figure 8:
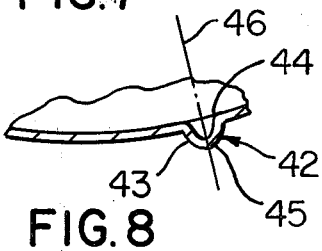
FIG. 8 is a fragmentary cross-sectional view illustrating an exemplary downwardly convex dimple in the form of a substantially parabolic dimple when viewed in cross section.

Each dimple 42 is in the form of a hollow dimple; and, in the exemplary embodiment of FIGS. 1–3, each dimple 42 is a hollow substantially hemispherical dimple having a base portion 43 provided with a circular outer periphery 44 and a rounded outer portion 45 which is substantially hemispherical. However, it will be appreciated that each dimple 42 need not necessarily be thus defined and reference is made to FIG. 8 of the drawings which illustrates another exemplary cross-sectional shape for a dimple 42 which may be employed in lieu of the dimple shape previously described. The dimple of FIG. 8 is also designated by the reference numeral 42; however, such dimple has a base portion 43 provided with a circular outer periphery 44 and a rounded outer portion 45 which is substantially parabolic in cross-section whereby such dimple 42 is substantially in the shape of a hollow paraboloid.

Each dimple 42 illustrated in FIGS. 1–3, 8, and 11–12 has been described above as having a circular outer periphery 44 defining its base portion 43 and such outer periphery preferably has a diameter ranging between $\frac{1}{8}$ inch to $\frac{1}{4}$ inch. Similarly, it will be appreciated that each of such dimples has a height measured substantially perpendicularly along its central axis 46 from an imaginary arcuate surface over its base portion adjoining the outer periphery of its base portion which is roughly equal to the diameter of such outer periphery whereby the height may range between $\frac{1}{8}$ inch and $\frac{1}{4}$ inch.

Figure 7:
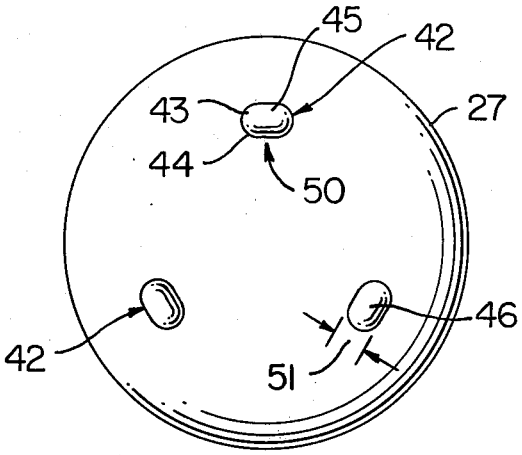
FIG. 7 is a view similar to FIG. 2 illustrating another exemplary embodiment of a container construction of this invention employing a plurality of three downwardly convex dimples each having a base portion of substantially elliptical peripheral outline.

It will also be appreciated that each dimple 42 need not necessarily have a base portion provided with a circular outer periphery. In particular, and as seen in FIG. 7 of the drawings, the outer periphery 44 of the base portion 43 may be substantially elliptical or oval and such ellipitical or oval outer periphery is also designated by the reference numeral 44 and shown at 50 for a typical one of the three feet or dimples 42 illustrated in FIG. 7. Each of the dimples 42 of FIG. 7 also have a central axis 46 with only one typical axis being thus designated and the outer periphery 44 of the oval base portion 43 is disposed radially inwardly from the side wall 27 by a distance at least equal to one-half the minimum dimension, illustrated as dimension 51, across the outer periphery as measured through the central axis 46.

Figure 6:
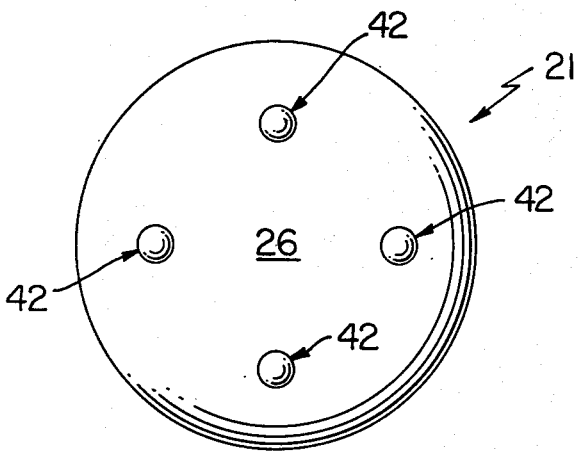
FIG. 6 is a view similar to FIG. 2 illustrating another exemplary embodiment of a container construction which employs a plurality of four downwardly convex dimples defining feet for the container construction.

Each container construction 21 and overall container or can 20 has been illustrated and described above as having a plurality of three feet or dimples 42 and such feet or dimples may be as described in FIGS. 1–3, 7, and 11–12. However, it will be appreciated that the container construction 21 may have a plurality of more than three dimples or feet 42. For example, the container construction 21 may have a plurality of four dimples 42 as shown in FIG. 6; and, such dimples may be identical in configuration to any one of the previously described dimples.

Figure 9:
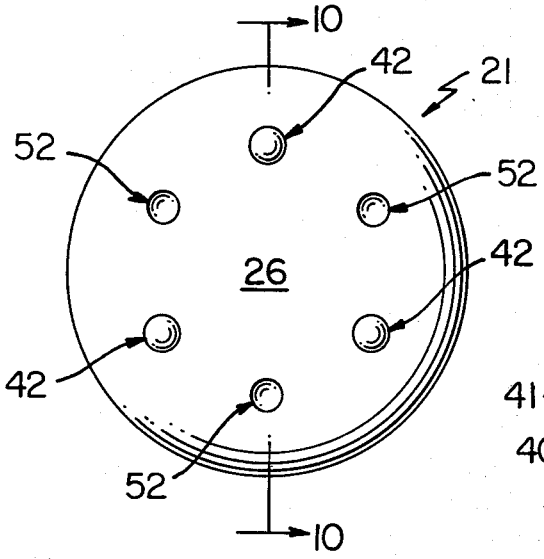
FIG. 9 is a view similar to FIG. 2 illustrating another exemplary embodiment of the container construction of this invention having a plurality of three feet defined by downwardly convex dimples and also having a plurality of three upwardly convex dimples disposed on the same circumference and carried between the downwardly convex dimples.

The dimples 42 in the bottom wall 26 of the container construction 21 and container 20 need not all serve as feet 42. For example, FIG. 9 illustrates the central part 34 of a bottom wall 26 of a container construction 21 having a plurality of three outwardly convex dimples 42 and three outwardly concave dimples also designated by the reference numeral 52 which may be substantially identical to the outwardly convex dimples 42 and are shown at 52. The three outwardly convex dimples 42 are disposed on an imaginary circle 120° apart while the outwardly concave dimples at 52 are disposed midway between the three outwardly convex dimples 42 which serve as feet also on the same imaginary circle and 120° apart thereby defining a symmetrical pattern of dimples in the bottom wall 26. The outwardly concave dimples 52 while not serving as feet serve to help rigidify the bottom wall 26 associated therewith.

Figure 4:
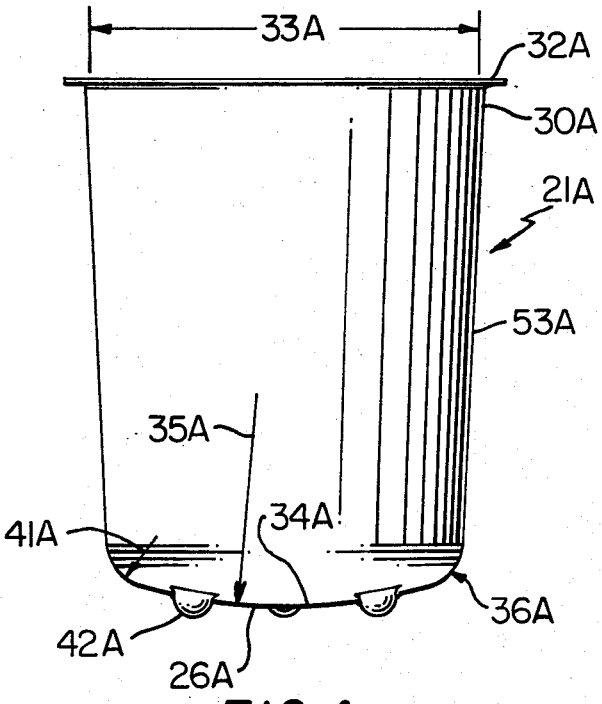
FIG. 4 is a side elevation of another exemplary embodiment of the container construction of this invention having a substantially frustoconical side wall which terminates in a top peripheral flange which is adapted to have a top closure fixed thereon.
Figure 5:
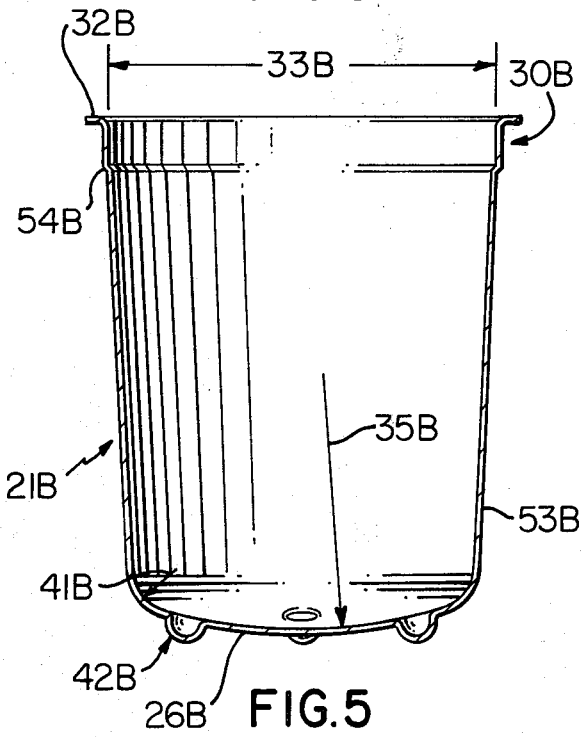
FIG. 5 is a cross-sectional view similar to FIG. 4 illustrating another exemplary embodiment of the container construction of this invention.

Other exemplary embodiments of the container construction of this invention are illustrated in FIGS. 4 and 5 of the drawings. The container constructions illustrated in FIGS. 4 and 5 are very similar to the container construction 21; therefore such container constructions will be designated generally by the reference numerals 21A and 21B respectively and parts of each container construction 21A and 21B which are similar to corresponding parts of the container construction 21 will be designated by the same reference numeral as in the construction 21 followed by an associated letter designation, either A or B, and not described again in detail. Only those component parts of each container construction 21A and 21B which are different from corresponding parts of the container construction 21 will be designated by new reference numerals followed by an associated letter designation and described in detail.

The main difference between the container construction 21A and the container construction 21 is that the side wall of construction 21A is a substantially tapered side wall which is in the form of substantially frustoconical side wall and is designated by the reference numeral 53A. The side wall 53A has a top portion 30A of a particular diameter also designated 33A; and, the relationships regarding the particular diameter 33A the radius 35A of the central part 34A of the bottom wall 26A and the radius 41A of the peripheral part 36A are within the limits previously described. Similarly, the feet or dimples 42A provided on the container construction 21A are disposed as previously described and may have any configuration previously described.

The container construction 21B of FIG. 5 has a tapered or substantially frustoconical side wall 53B similar to the side wall 53A. The main difference between the construction 21B and the construction 21A is the provision of the outwardly offset wall portion 54B therein and the provision of four feet or dimples 42B instead of three. The construction 21B also has a top portion 30B of a particular diameter 33B. The relationships of the diameter 33B, radius 35B of the central part 34B of the bottom wall 26B, and radius 41B of the peripheral part 36B are also within the limits previously described.

Each container construction 21A and 21B may have a suitable top closure fixed to its respective peripheral flange 32A and 32B. The top closure may be very similar to closure 22 and may be fixed in position employing any suitable technique known in the art to define a container construction or container similar to the container 20 for containing a suitable product under pressure.

The container construction of this invention may be made or formed employing any suitable technique known in the art and may be made from ferrous metal or aluminous metal. Container constructions similar to the container construction 21 have been made of type 3004 aluminum alloy with bottom wall thicknesses ranging between 0.0075 inch and 0.012 inch. It will be appreciated that such bottom wall thicknesses are substantially smaller than the thickness of a bottom wall which is usually provided on commercially produced aluminous beverage containers which are provided without feet and range in thickness between 0.0128 and 0.0142 inch whereby substantial material savings are possible employing the footed container construction 21 of this invention.

The container construction of this invention has been shown to have optimum vertical stability even when subjected to high internal pressures as high as 100 pounds per square inch gage (psig). To illustrate this point, the following Table A presents results of tests conducted on a typical tapered container having a five fluid ounce capacity and of the type illustrated in FIG. 4 and having three dimples or feet. The container of FIG. 5, tested as presented in Table A, was made of 5050 H 19 aluminum alloy with the bottom wall and integral side wall having a nominal thickness of 0.0075 inch and sealed at its open end with a suitable closure through which a pipe was extended in sealed relation for pressurizing the interior thereof to simulate pressurization similar to that encountered if such container contained a carbonated beverage, for example. The container was subjected to different internal air pressures and measurements were taken from a horizontal plane to the outside surface of the center of the central part 34 of the bottom wall 26 and to the center of the outside surface of outer portion 45 of each dimple or foot 42.

TABLE A

| Internal Pressure psig | Dimension to Center of Container Bottom Wall (inch) | Dimension to Center of Each Dimple (inch) |
|---|---|---|
| 0 | 0 | .040 |
| 10 | .009 | .045 |
| 20 | .016 | .047 |
| 30 | .023 | .050 |
| 40 | .030 | .054 |
| 50 | .037 | .059 |
| 60 | .045 | .066 |
| 70 | .054 | .073 |
| 80 | .063 | .079 |
| 90 | .070 | .084 |
| 100 | .079 | .091 |
| Return to 45 | .066 | .090 |
| 0 | .047 | .081 |

From the above table A it is seen that at 0 psig the center of the container was considered as being at 0 dimension and the center of each dimple or foot was measured at 0.040 inch beyond the center of the central part 34. At 100 psig the distance measured to the center of the container was 0.079 inch while the distance to the center of each dimple was 0.091 indicating a difference of 0.012 inch whereby the container construction could still be supported on its feet and hence stable.

It will be noted that the pressure was then returned to 45 psig which would be typical if the container were to contain a carbonated beverage such as beer. For example, beer is normally pasteurized in its container or can and the pressure therein during pasteurization increases generally to about 80 psig. Once the beer is returned to normal room temperature and then further cooled in a typical household refrigerator, the pressure ordinarily returns to about 45 psig. Under these conditions it is seen that there is still a difference of 0.023 inch from the center of the container to the center of each dimple indicating that the container may be supported on its feet or dimples in a stable manner. Likewise, a return to 0 psig indicates that while there has been some plastic deformation of the container, there is still a difference of 0.034 inch from the center of the container to the center of each dimple highlighting the stability of the container.

To further highlight the vertical stability of the container construction of this invention, reference is also made to the following Table B which presents test results conducted in a similar manner as those in Table A for a 5 fluid ounce container construction which is similar to the container construction of FIG. 1 with the exception that the bottom wall thereof is identical to the bottom wall illustrated in FIG. 9. The five fluid ounce container construction presented in Table B is also made of 5050 H 19 aluminum alloy having a 0.0075 inch gage thickness.

TABLE B

| Internal Pressure psig | Dimension to Center of Container Bottom Wall (inch) | Dimension to Center of Each Dimple (inch) |
|---|---|---|
| 0 | .0 | .041 |
| 10 | .012 | .046 |
| 20 | .018 | .050 |
| 30 | .025 | .053 |
| 40 | .032 | .057 |
| 50 | .041 | .064 |

TABLE B-continued

| Internal Pressure psig | Dimension to Center of Container Bottom Wall (inch) | Dimension to Center of Each Dimple (inch) |
|---|---|---|
| 60 | .050 | .071 |
| 70 | .059 | .079 |
| 80 | .068 | .085 |
| 90 | .075 | .090 |
| 100 | .084 | .095 |
| Returned to 45 | .069 | .095 |
| 0 | .048 | .086 |

As previously indicated, the container construction of this invention may be made utilizing any suitable material known in the art and preferably such container construction is made employing aluminous materials such as 3004 aluminum alloy or 5050 H 19 aluminum alloy. Further, the container construction of this invention may be made using any suitable forming technique known in the art.

While present exemplary embodiments of this invention, and methods of practicing the same, have been illustrated and described, it will be recognized that this invention may be otherwise variously embodied and practiced within the scope of the following claims.

What is claimed is:

1. In an easily hand-held metal container construction having a downwardly convex bottom wall and an adjoining side wall defined as a single-piece seamless structure with said side wall terminating at a top portion adapted to have a top closure fixed thereon, said top portion, when viewed on a plane perpendicular to the longitudinal axis of said container construction, having a circular cross-section configuration and having a particular diameter, the improvement wherein said bottom wall, when viewed on any cross-sectional plane coinciding with said longitudinal axis of said container construction, has a central part which extends in a circular first radius and a peripheral part defined by a side portion which blends smoothly with said central part and said side wall, said side portion extending on a second radius, said first radius, when measured along the longitudinal axis of said container, being within the range of 2 to 7 times greater than the dimension of said particular diameter and said second radius being within the range of 1/10 to 1/5 the dimension of said particular diameter, said first radius and said second radius having a dimensional ratio which provides a smooth transition between their respective central and peripheral parts which is free of sharp corners and with minimum wrinkling, said downwardly convex bottom wall having a plurality of integral feet for supporting said construction thereon, each of said feet being defined by a downwardly convex dimple having a base portion provided with an outer periphery, and said bottom wall also having a plurality of dimples to rigidify said bottom wall, said rigidifying dimples each being defined by a downwardly concave dimple having a base portion provided with an outer periphery, said outwardly convex dimples and said outwardly concave dimples having a wall thickness which is substantially the same as the remainder of said bottom wall and each of said convex and concave dimples having a central axis and having the outer periphery of its base portion disposed radially inward from said side wall by a distance of at least equal to one-half the minimum dimension across said outer periphery when measured through said central axis, said central part and said peripheral part blending smoothly together substantially on an imaginary circular line and each of said convex and concave dimples being disposed so that the central axis of each dimple is disposed adjacent said imaginary circular line and said concave dimples being symmetrically disposed between said convex dimples.

2. In a container construction as set forth in claim 1 the further improvement wherein each of said convex and concave dimples is a hollow, substantially hemispherical dimple.

3. In a container construction as set forth in claim 1 the further improvement wherein said outer periphery of the base portion of each convex and concave dimple is substantially circular in shape.

4. In a container construction as set forth in claim 3 the further improvement wherein said outer periphery of the base portion of each convex and concave dimple has a diameter ranging between $\frac{1}{8}$ inch (0.319 centimeter) and $\frac{1}{4}$ inch (0.637 centimeter).

5. In a container construction as set forth in claim 4 the further improvement wherein each of said convex and concave dimples has a height measured substantially perpendicularly along its central axis from an arcuate surface over its base portion which is roughly equal to the diameter of its base portion.

6. In a container construction as set forth in claim 1 the further improvement wherein said side wall of said single-piece structure has a thickness which is no greater than the thickness of said bottom wall.

7. In a container construction as set forth in claim 6 the further improvement comprising making said single-piece structure of an aluminous material in which said bottom wall has a thickness ranging between 0.0075 and 0.012 inch.

8. In a container construction as set forth in claim 1 the further improvement wherein said side wall of said single-piece structure is a right circular cylindrical wall terminating in said top portion having an annular flange for fixing said top closure thereon.

9. In a container construction as set forth in claim 8 the further improvement wherein said side wall of said single-piece structure is a frustoconical side wall terminating in said top portion having an annular flange for fixing said top closure thereon.

10. In a container construction as set forth in claim 9 the further improvement wherein said frustoconical side wall has a radially outwardly offset tubular portion comprising its top portion, said annular flange extending from said radially outwardly offset tubular portion.

11. In a container construction as set forth in claim 1 the further improvement wherein said plurality of integral feet comprises at least three feet and said plurality of rigidifying dimples comprises at least three dimples.

12. In a container construction as set forth in claim 1 the further improvement wherein said plurality of integral feet comprises three feet disposed 120° apart on said imaginary circular line and said plurality of rigidifying dimples comprises three dimples disposed 120° apart on said imaginary circular line symmetrically arranged between said feet.

* * * * *